United States Patent [19]

Sakurai

[11] Patent Number: 4,523,175

[45] Date of Patent: Jun. 11, 1985

[54] DUAL SHAFT ROTARY ELECTRIC DEVICE

[75] Inventor: Michio Sakurai, Miyagi, Japan

[73] Assignee: Alps Electric Co., Ltd., Tokyo, Japan

[21] Appl. No.: 579,665

[22] Filed: Feb. 13, 1984

[30] Foreign Application Priority Data

Feb. 12, 1983 [JP] Japan ..... 58-18111[U]

[51] Int. Cl.[3] ..... H01C 10/16; H01H 19/58

[52] U.S. Cl. ..... 338/134; 338/132; 338/166; 338/184; 200/14

[58] Field of Search ..... 338/132, 134, 127, 125, 338/123, 166, 171, 184; 200/14, 11 DA, 11 G, 11 J, 11 R

[56] References Cited

U.S. PATENT DOCUMENTS

| | | | |
|---|---|---|---|
| 2,493,184 | 1/1950 | Budd et al. | 338/134 |
| 2,927,168 | 1/1960 | Brown | 200/18 |
| 3,736,390 | 5/1973 | Lockard | 200/11 G |
| 3,918,022 | 11/1975 | Puerner | 338/134 |
| 3,988,711 | 10/1976 | Van Beuthuysen et al. | 338/134 |
| 4,353,053 | 10/1982 | Matsui et al. | 338/132 |

FOREIGN PATENT DOCUMENTS

| | | | |
|---|---|---|---|
| 522063 | 2/1956 | Canada | 338/134 |
| 1347473 | 5/1971 | United Kingdom | 338/134 |

*Primary Examiner*—Roy N. Envall, Jr.
*Assistant Examiner*—C. N. Sears
*Attorney, Agent, or Firm*—Guy W. Shoup; Gerard F. Dunne

[57] ABSTRACT

A dual shaft rotary electric device comprises inner and outer concentric shafts, slider supports attached to the inner and outer shafts respectively, sliders attached to the slider supports respectively, and insulating substrates stacked in the longitudinal direction of the dual shaft arrangement and respectively correspondingly to said sliders. An insulating spacer is inserted between the insulating substrates, and is held in place by opposite arms of a front side plate.

6 Claims, 3 Drawing Figures

DUAL SHAFT ROTARY ELECTRIC DEVICE

BACKGROUND OF THE INVENTION

1. Field of the Invention

The present invention relates to a dual shaft electric device and particularly to such a device in which a dual shaft arrangement is formed by concentric inner and outer shafts, and in which slider supports provided with sliders respectively fixed thereto are attached to the inner and outer shafts for engagement with respective contact patterns.

2. Description of the Prior Art

Conventionally, a dual shaft variable resistor includes an inner shaft connected to a slider carrying contacts adapted to slide across resistance elements carried on a substrate, and an outer shaft also carrying a slider. The slider of the outer shaft carries contacts adapted to slide along resistance elements formed on another substrate, and the two substrates are separated axially of the shafts by a spacer. Recently, such dual shaft variable resistors are assembled by stacking the respective parts on the concentric shafts by means of an automatic machine. However, this method of assembly results in a disadvantage in that the insulating substrate of the variable resistor first placed on the shaft may ride along the shaft with the insulator spacer because it is pushed along the shaft by a spring or the like provided for the slider, so as to make it difficult to position the substrate of the next variable resistor, resulting in difficulty in automatic assembling.

SUMMARY OF THE INVENTION

An object of the present invention is, therefore, to eliminate the disadvantage as mentioned above for the prior art.

Another object of the present invention is to provide a dual rotary electric device in which an insulating substrate disposed initially on the shafts during assembly is prevented from moving along the shaft to thereby facilitate automatic assembling of the device.

DETAILED DESCRIPTION OF THE INVENTION

Figure 1:
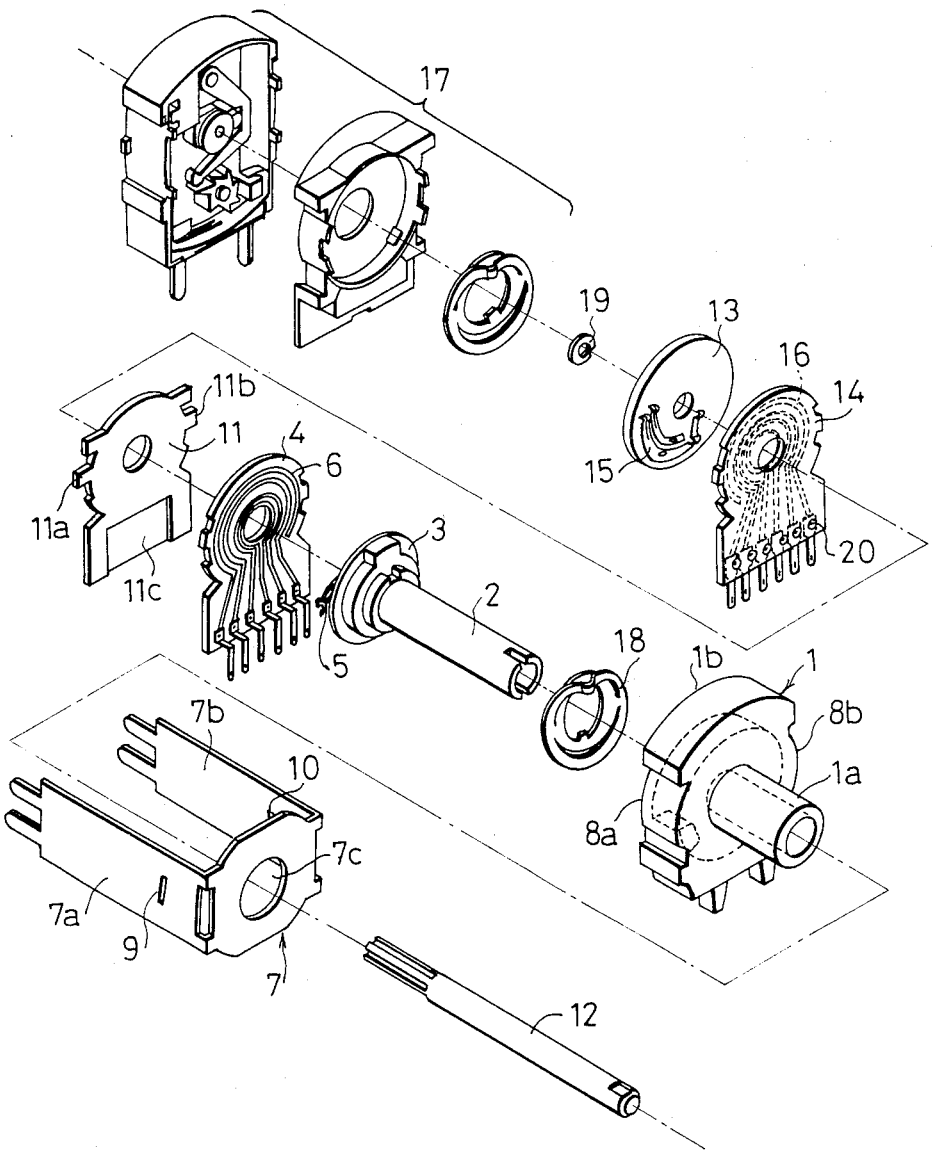
FIG. 1 is an exploded perspective view of a dual shaft variable resistor according to an embodiment of the present invention.

Referring to the drawings, an embodiment of the present invention will be now described.

Figure 2:
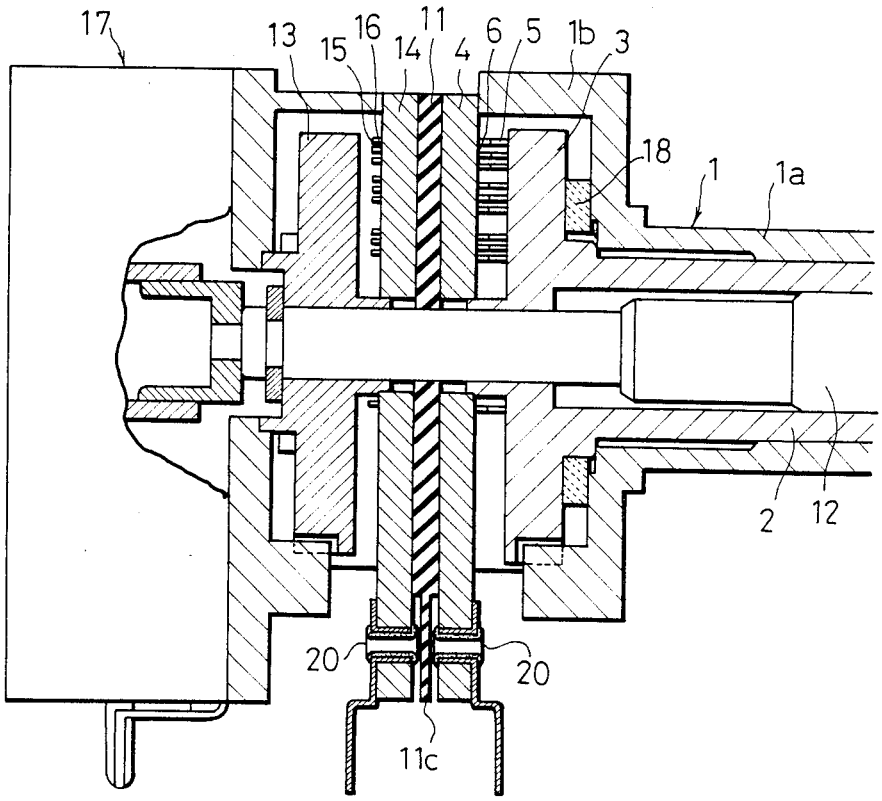
FIG. 2 is a cross-sectional side view of the assembled dual shaft variable resistor of FIG. 1.
Figure 3:
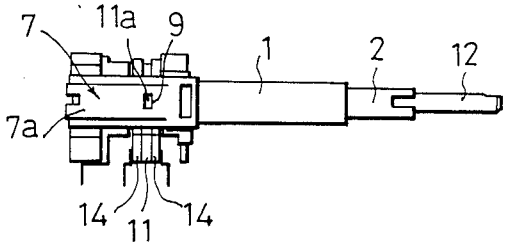
FIG. 3 is a side view of the dual shaft variable resistor of FIG. 2.

A shaft bearing 1 formed by zinc die casting includes a bearing portion 1*a* integrally molded with a cup-like frame portion 1*b*. An outer shaft 2 made of an insulating material such as glass polyacetal is loosely inserted into the bearing portion 1*a* of the shaft bearing 1. The outer shaft 2 has at its inner end a disc-like slider support 3 integrally molded therewith. An insulating substrate 4 of a lower stage (right stage in FIG. 2) is disposed so as to cover the opening side of the frame portion 1*b* so that a slider 5 fixed on the inner surface of the slider support 3 may be slid along a resistive element 6 formed on the insulating substrate 4 by rotation of the outer shaft 2. A U-shaped front side plate 7 having a pair of arms 7*a* and 7*b* is provided at the side of the frame portion 1*b* such that the pair of arms 7*a* and 7*b* are fitted into a pair of grooves 8*a* and 8*b* formed at opposite sides of the frame portion 1*b*. A pair of protrusions 11*a* and 11*b* formed at the opposite sides of an insulating spacer 11 are inserted into a pair of small holes 9 and 10 formed in the arms 7*a* and 7*b* of the side plate 7 respectively, so that the insulating spacer 11 may be fixed at the inner surface of the insulator substrate 4 so as to hold the insulating spacer 11 in place. An inner shaft 12 is loosely inserted into the outer shaft 2, and a slider support 13 is fixed by a washer 19 to the inner end of the inner shaft 12. An insulating substrate 14 of the upper stage (left stage in FIG. 2) is arranged such that as the inner shaft 12 rotates, a slider 15 provided on the slider support 13 is slid along a resistive element 16 provided on the insulating substrate 14 to thereby vary the resistance value. A switch mechanism 17 is provided on the insulating substrate 14 and is actuated by being pushed by the inner shaft 12.

Assembling of the dual shaft variable resistor according to the embodiment will be described. First, the bearing portion 1*a* of the shaft bearing 1 is inserted into a fitting hole 7*c* formed in the U-shaped front side plate 7 with the arms 7*a* and 7*b* fitted into the grooves 8*a* and 8*b* of the frame portion 1*b*. Then, the outer shaft 2, to which the slider support 3 with the slider 5 attached thereto has been previously fixed, is loosely inserted into the shaft bearing portion 1*b*, so that the slider support 3 fixed to the outer shaft 2 is mounted on the bottom of the frame portion 1*b* through a spring 18. Next, the insulating substrate 4 of the lower stage is mounted on the open side of the frame portion 1*b* in the state that the insulating substrate 4 is held by the pair of arms 7*a* and 7*b* of the front side plate 7, and then the protrusions 11*a* and 11*b* formed at the opposite sides of the insulating spacer 11 are respectively inserted into the small holes 9 and 10 of the insulating spacer 11 so as to fix the insulating spacer 11 in place.

The insulating substrate 14 of the upper stage is next mounted on the insulating spacer 11 in the state that the insulating substrate 14 is held by the arms 7*a* and and the inner shaft 12 to which the slider support 13 has been fixed by the washer 19 is loosely inserted into the outer shaft 2 so that the slider 15 fixed on the slider support 13 is placed in contact with the resistive element 16 on the insulator substrate 14 of the upper stage to vary the resistance value of the resistive element 16 on the insulating substrate 14 as the inner shaft 12 rotates. Finally, the switch mechanism 17 is attached by caulking at its upper surface (left surface in FIG. 2) with the forward ends of the pair of arms 7*a* and 7 of the front side plate 7.

In the thus arranged dual shaft variable resistor according to the embodiment of the present invention, even when the parts are successively stacked upward from the lowermost one to the uppermost one in the longitudinal direction of the shafts to assemble the variable resistor by utilizing an automatic machine or the like, the insulating substrate 4 of the lower stage is prevented by the insulating spacer 11 from moving up toward the upper stage, so that the positioning of the insulating substrate 14 of the upper stage can be performed very smoothly and the automatic assembling by using an automatic machine can be progressed very satisfactorily. Owing to the existence of the insulating space 11, there is no risk of the dielectric breakdown accident or the like even when the two insulator substrates 14 and 4 of the upper and lower stages respectively are arranged close to each other and to doubly assure against the dielectric breakdown, the portion 11*c* of the insulative spacer 11 opposed to rivets 20 of the insulating substrates 4 and 14 is made thin. Although the embodiment has been described above with respect to a dual shaft variable resistor by way of example, the application of the present invention is not restricted to such a variable resistor but can be widely applied to any dual shaft rotary electric device, for example an encoder.

What is claimed is:

1. A dual shaft rotary electric device comprising a dual shaft arrangement constituted by inner and outer concentric shafts, slider supports attached to said inner and outer shafts respectively, sliders attached to said slider supports respectively and insulating substrates stacked in the longitudinal direction of said dual shaft arrangement and respectively correspondingly to said sliders, in which an insulating spacer is inserted between said insulating substrates and a front plate having side arms extending generally parallel to said dual shaft arrangement and engaging said spacer to hold it in place.

2. A dual shaft rotary electric device according to claim 1, in which said insulating spacer is formed with a thin portion opposed to a terminal riveting portion of each of said insulator substrates.

3. A dual shaft rotary electric device according to claim 1, in which said front side plate is formed at its opposite arms with small holes respectively and protrusions of said insulator spacer are fitted into said small holes.

4. A dual shaft rotary electric device including inner and outer rotary shafts arranged concentrically and connected to respective stages of said electric device, said stages each including a respective slider connected to a respective shaft and adapted to slide along a respective substrate upon rotation of the respective shaft, an insulating spacer held between said stages, and means including a front plate having two arms extending parallel to said shafts and engaging said spacer for holding it in position during assembly of said device.

5. A device according to claim 4, said substrates each having terminals fastened thereto, said spacer having recessed portions adjacent said terminals.

6. A device according to claim 4, said spacer having protrusions adapted to fit within complimentary holes in said arms.

* * * * *